United States Patent [19]

Brandi et al.

[11] Patent Number: 4,859,117

[45] Date of Patent: Aug. 22, 1989

[54] REVERSIBLE MECHANICAL COUPLING, PARTICULARLY FOR TENSIONAL ANCHORAGES

[75] Inventors: Roberto Brandi, Padua; Apollonio De Meio, Belluno, both of Italy

[73] Assignee: AGIP, S.p.A., Milan, Italy

[21] Appl. No.: 307,007

[22] Filed: Feb. 7, 1989

[30] Foreign Application Priority Data

Feb. 12, 1988 [IT] Italy ..... 19387 A/88

[51] Int. Cl.[4] ..... E02B 17/00

[52] U.S. Cl. ..... 405/224; 405/195; 166/340; 403/322

[58] Field of Search ..... 405/224, 195, 225, 227; 166/340, 338, 339, 341, 342; 403/322; 114/294; 285/18, 24, 27

[56] References Cited

U.S. PATENT DOCUMENTS

| | | | |
|---|---|---|---|
| 2,794,633 | 6/1957 | Delany | 403/322 X |
| 3,325,190 | 6/1967 | Eckert et al. | 166/340 X |
| 3,628,812 | 12/1971 | Larralde | 403/322 X |
| 3,738,693 | 6/1973 | Loustalet | 403/322 X |
| 4,372,707 | 2/1983 | Ostgaard | 405/224 |
| 4,432,670 | 2/1984 | Lawson | 405/224 |
| 4,611,953 | 9/1986 | Owens | 405/224 |
| 4,664,558 | 5/1987 | De Meio et al. | 405/224 |

FOREIGN PATENT DOCUMENTS

| | | | |
|---|---|---|---|
| 631394 | 11/1961 | Canada | 403/322 |

*Primary Examiner*—Dennis L. Taylor
*Attorney, Agent, or Firm*—Morgan & Finnegan

[57] ABSTRACT

A reversible mechanical coupling to be clamped in a suitable seat by means of clamping levers and wedges, in which the clamping levers are pivoted to arms rigid with said wedges by two lateral pivots which are inserted through vertical slots in said arms and are retained at the lower end of said slots by the narrow but forcible mouth of springs of tuning-fork shape mounted in correspondence with said slots, said clamping levers being also provided with laterally projecting pegs which are inserted in suitably shaped guides provided in protection casins interposed between the clamping levers and fixed to the coupling body.

4 Claims, 5 Drawing Sheets

10
9
13
12
3
2
1
12
22'
3
2
12
B
10
9
13
12
20
22
3
2
12
13
9
10
12
B 10
16
18
6
5
19'
18
22
16
1
10
4
16
18
6
5
19'
18
16
10
16
18
6
5
19'
18
16
10

REVERSIBLE MECHANICAL COUPLING, PARTICULARLY FOR TENSIONAL ANCHORAGES

This invention relates to a novel reversible mechanical coupling which, as both the wedges and the clamping levers can be operated by a single command and as the clamping levers are not springloaded, is of considerable constructional and operational simplicity and of small longitudinal dimensions and requires small operating forces, it therefore being of relatively low cost and high reliability.

Basically, the coupling according to the present invention represents an improvement in the reversible coupling of the preceding (U.S. Pat. No. 4,664,558 Canadian Pat. No. 1,232,769 issued on Feb. 16, 1988) by the present applicant.

This coupling consists substantially of a tubular body terminating lowerly in a conical widened portion arranged to cause radial expansion of a series of clamping levers pivoted about a linking ring moved axially to the tubular body by a series of hydraulic cylinders supported by said body, said clamping levers being kept in contact with said body by springs, and being in mechanical interference, when in an expanded position, with a conical surface on the coupling seat. A series of vertical guides is also provided on the upper wall of the tubular body to guide a series of wedges pivoted about an upper linking ring moved axially to the cylindrical body by another series of hydraulic cylinders also supported by said body.

Such an arrangement has however resulted in various drawbacks due substantially to the fact that the clamping lever system is independent of the wedge system, resulting in the need to use double cylinders, double lines etc. with consequent increased cost and constructional complexity, the need to provide flow partitioners to ensure that all the clamping levers and wedges undergo the same path of travel, with consequent constructional complications, and the resultant need to provide very lengthy, bulky and heavy coupling bodies to house the double hydraulic systems. A further drawback is the fact that the clamping levers are kept adhering to the coupling body by springs which inevitably exert a different force according to the position assumed by the clamping levers and in any event give rise to an unrequired contact pressure. In this respect, said springs cause the clamping levers to slide along the coupling body as they undergo their movement, which takes place under the high and deleterious contact force exerted by the spring, resulting in a considerable friction force to be overcome. On the other hand, said springs exert only a minimum force in keeping the clamping levers adhering to the coupling body when said clamping levers are in their retracted position and the coupling is being manipulated, ie precisely when reliable locking of the clamping levers in their retracted position should be ensured to prevent them hindering the movements of the entire coupling, whereas in contrast they exert maximum force in holding the clamping levers in contact with the widened portion on the coupling body when said clamping levers are completely extended outwards, with the consequent need for considerable force to retract them, for example when the coupling is to be released.

The object of the present invention is to obviate said drawbacks by providing a reversible mechanical coupling comprising a series of clamping levers and a series of wedges which are connected together in such a manner that they can be operated by a single hydraulic system, and in which the series of clamping levers is not spring-loaded, but instead follows a guided path trajectory. This is attained substantially by pivoting the clamping levers on arms rigid with said wedges but in such a manner that these latter can undergo movements independent of those of the clamping levers. More specifically, each clamping lever is pivoted by two lateral pivots which are inserted through two vertical slots provided in the arms rigid with an overlying wedge, said pivots being retained in the lower position in said slots by the narrow but openable mouth of two springs of tuning-fork shape mounted in a position corresponding with said slots. In this manner, by forcing said narrow mouth of the springs against said pivots of the clamping levers when these are in their end-of-travel position, said pivots overcome said mouth and can therefore slide along the entire length of the slot to allow corresponding movement of the wedge. Each clamping lever also comprises two laterally projecting pegs which slide along guides provided in protection casings interposed between the clamping levers and fixed to the tubular body, said guides being of such a shape as to cause said clamping lever to undergo the required expansion movements when descending and retraction movements when rising, while at the same time keeping said clamping levers continuously adhering to the coupling body, ie performing the functions already performed by said springs of the known coupling, but without the corresponding stated drawbacks.

Thus, the reversible mechanical coupling to be clamped within a suitable seat provided in particular in a foundation base for anchoring to said base one of the tensioned tubular anchorages of a tension leg marine platform, said coupling consisting substantially of a tubular body provided upperly with vertical guides for a series of wedges pivoted to a guide sleeve slidably driven along said body by hydraulic cylinders hinged between said body and said sleeve, and provided lowerly with a terminal widened portion arranged to cause radial expansion of an analogous series of clamping levers kept in contact with said body by mechanical means, is characterised according to the present invention in that said clamping levers are pivoted respectively to arms rigid with said wedges, each by two lateral pivots which are inserted through corresponding vertical slots in said arms and are retained at the lower end of said slots by the narrow but forcible mouth of two springs of tuning-fork shape mounted in correspondence with said slots, said mechanical means for maintaining contact between the clamping levers and said tubular body consisting of two pegs projecting laterally from each clamping lever and compelled to slide along guides of suitable shape provided in protection casings interposed between said clamping levers and fixed to the tubular body.

According to a further characteristic of the present invention, the engagement between said lateral pivots of the clamping levers and the corresponding slots is made with slight constructional clearance to prevent any movements of the clamping levers being able to result in excessive stresses in the pivots when the coupling is clamped to the seat.

According to a further characteristic of the present invention the inclination of the wedges and relative vertical guides is less than the minimum friction angle, thus making said wedges and said guides self-locking to prevent any relative sliding and corresponding slackening between them, even when there is no pressure in the hydraulic cylinders.

Finally, according to a preferred embodiment of the present invention, said corresponding series of clamping levers and wedges comprise respectively three clamping levers and three wedges disposed mutually superposed at 120° apart.

The invention is described in detail hereinafter with reference to the accompanying drawings, which illustrate a preferred embodiment thereof by way of non-limiting example in that technical or constructional modifications can be made thereto but without leaving the scope of the present invention.

Figure 1:
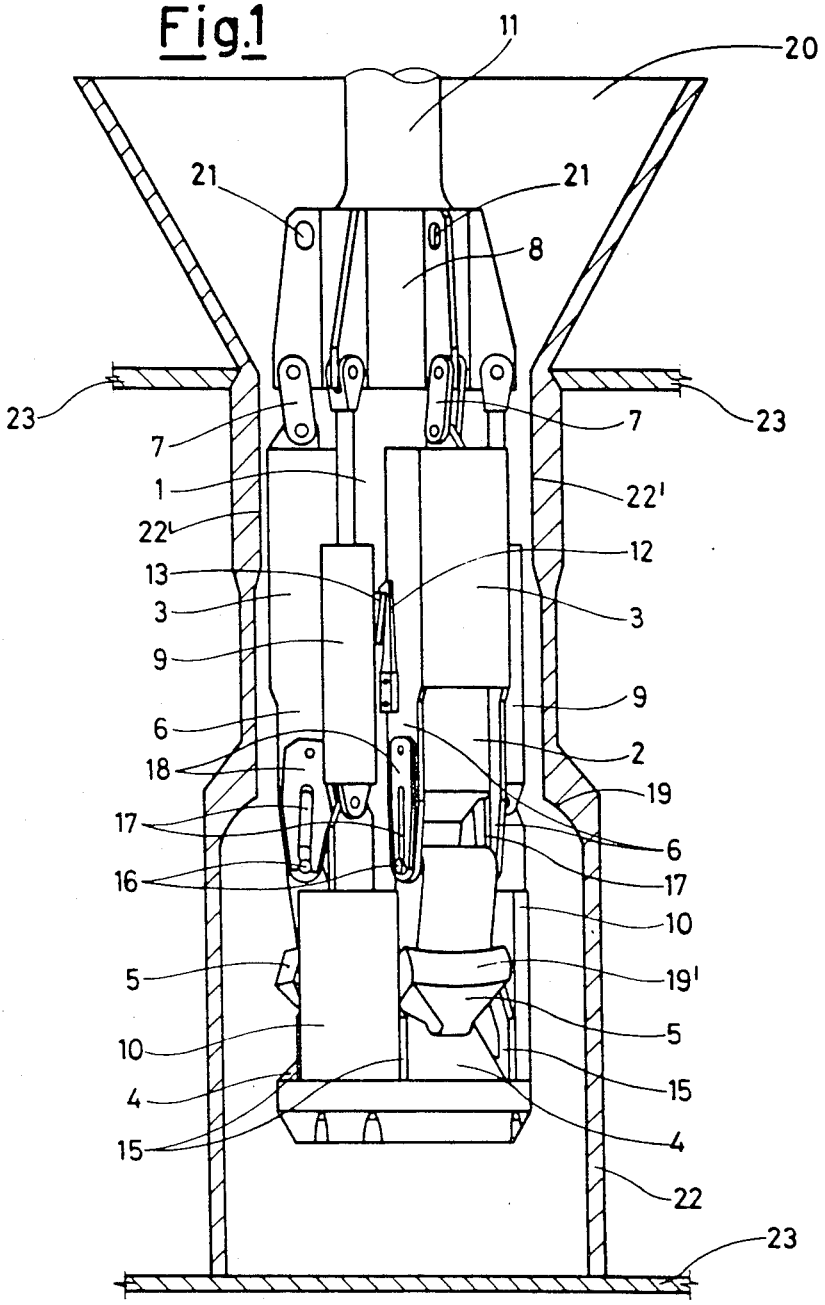
FIG. 1 is a front view of the coupling according to the invention already inserted but not yet clamped in the relative seat, which is shown sectioned.
Figure 2:
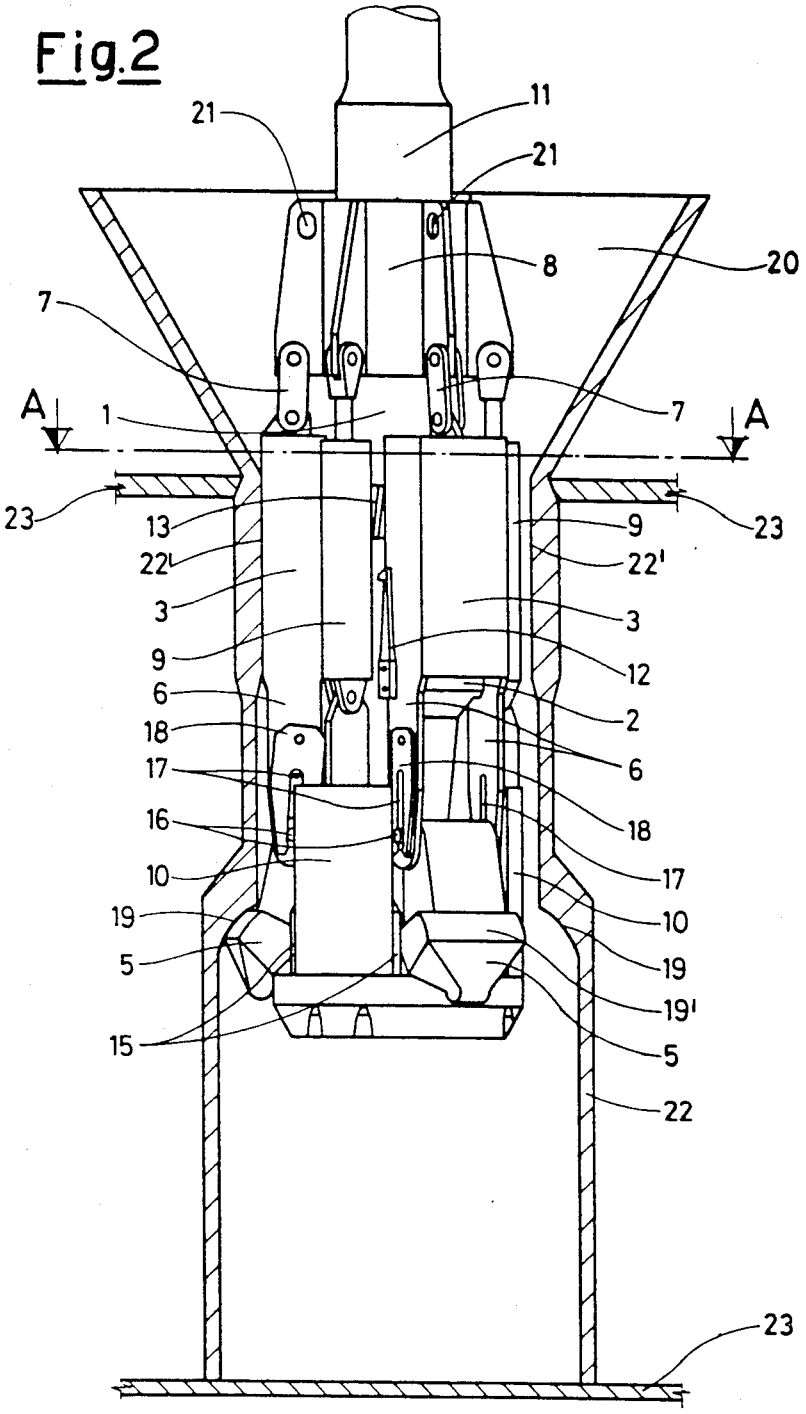
FIG. 2 is a front view of the coupling according to the invention inserted and clamped in the relative seat, which is shown sectioned.
Figure 3:
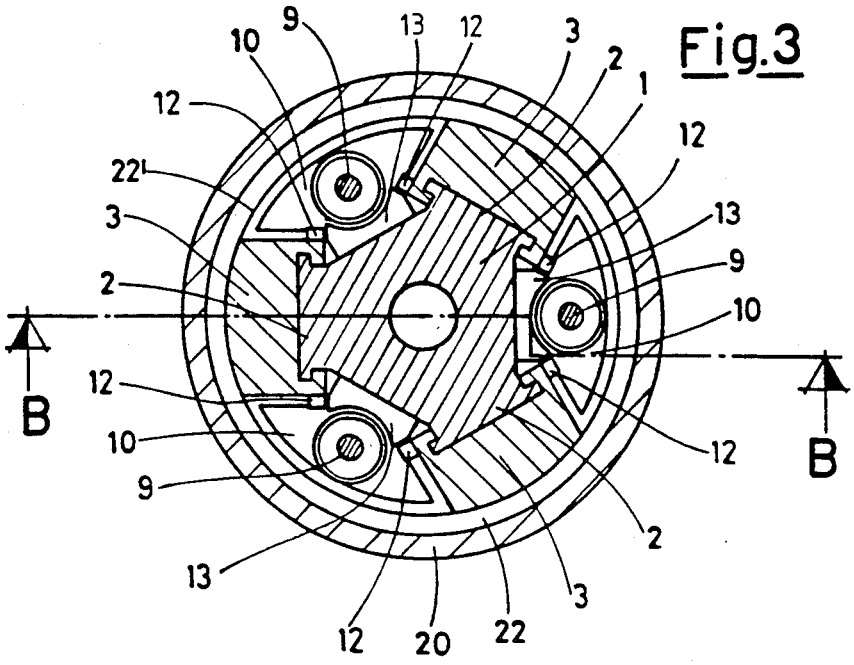
FIG. 3 is a section through the coupling on the line A—A of FIG. 2.
Figure 5:
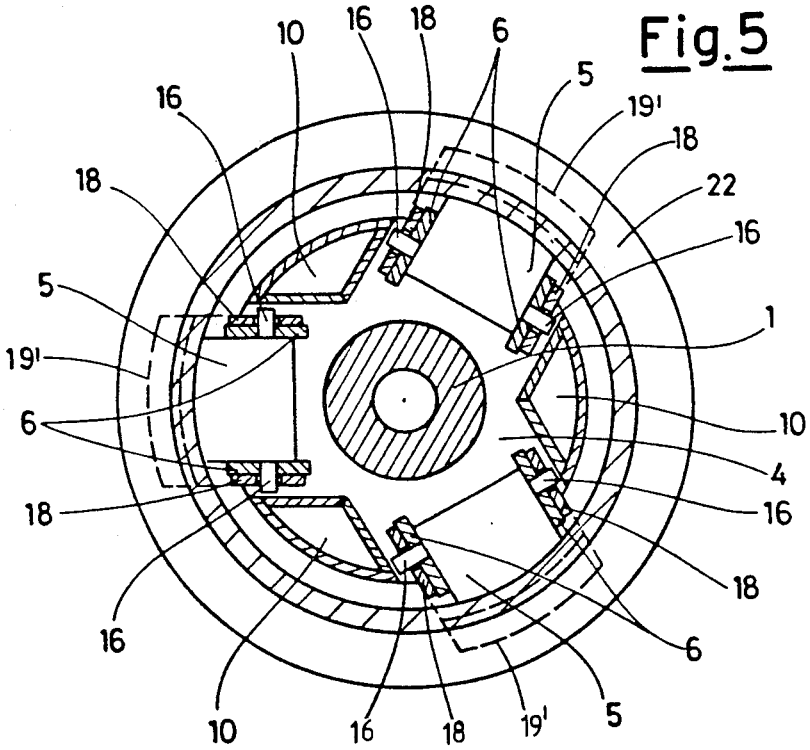
FIG. 5 is a section through the coupling on the line C—C of FIG. 4.
Figure 4:
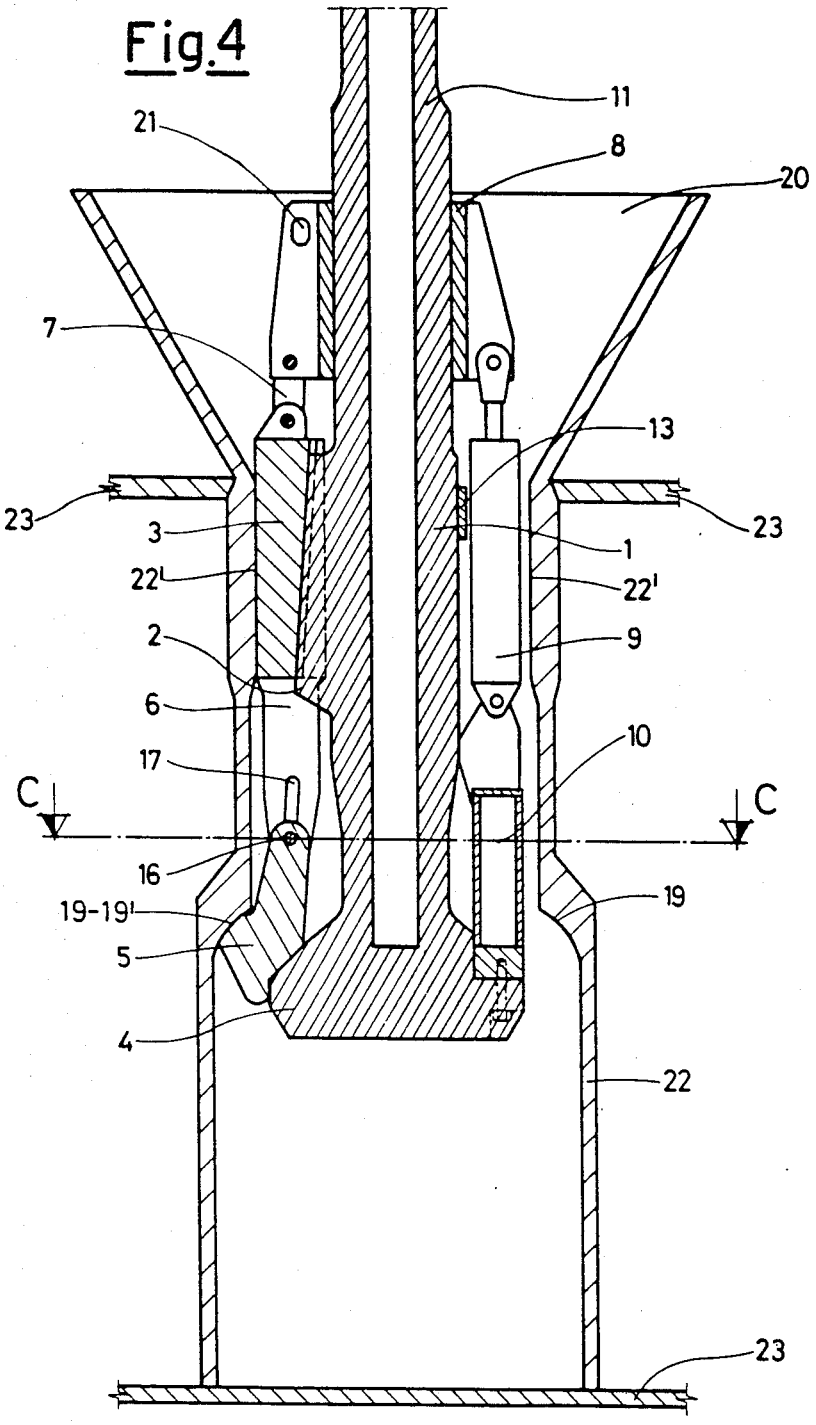
FIG. 4 is a section through the coupling of the invention clamped in its seat, the section being taken on the line B—B of FIG. 3.

With reference to the figures, the coupling is formed of a tubular body 1 provided in its upper zone with guides 2 for the wedges 3, its lower end comprising a widened portion 4 with inclined or conical surfaces to cause the clamping levers 5 to expand radially.

The clamping wedges 5 are pivoted to arms 6 rigid with the wedges 3, which are connected by connecting links 7 to the guide sleeve 8 slidable on the body 1.

The rods of the hydraulic cylinders 9 are pivoted to the guide sleeve 8, the cylinders themselves being hinged to the protection and guide casings 10 for the clamping levers 5, and which are fixed to the lower end of the widened portion 4 of the body of the coupling 1.

By the action of the hydraulic cylinders 9 the guide sleeve 8 can slide on the upper part 11 of the coupling body, transmitting its movement to the wedges 3 and clamping levers 5.

When the hydraulic cylinders 9 are in their extended position, and consequently the guide sleeve 8, the wedges 3 and clamping levers 5 are in their upper end-of-travel position, the support hooks 12 fixed to the wedges 3 engage in the hook connectors 13 fixed to the coupling body.

The support hooks 12 are able to support the weight of the guide sleeve 8 and of the members suspended from it, in the absense of pressure in the hydraulic cylinders.

Figure 6:
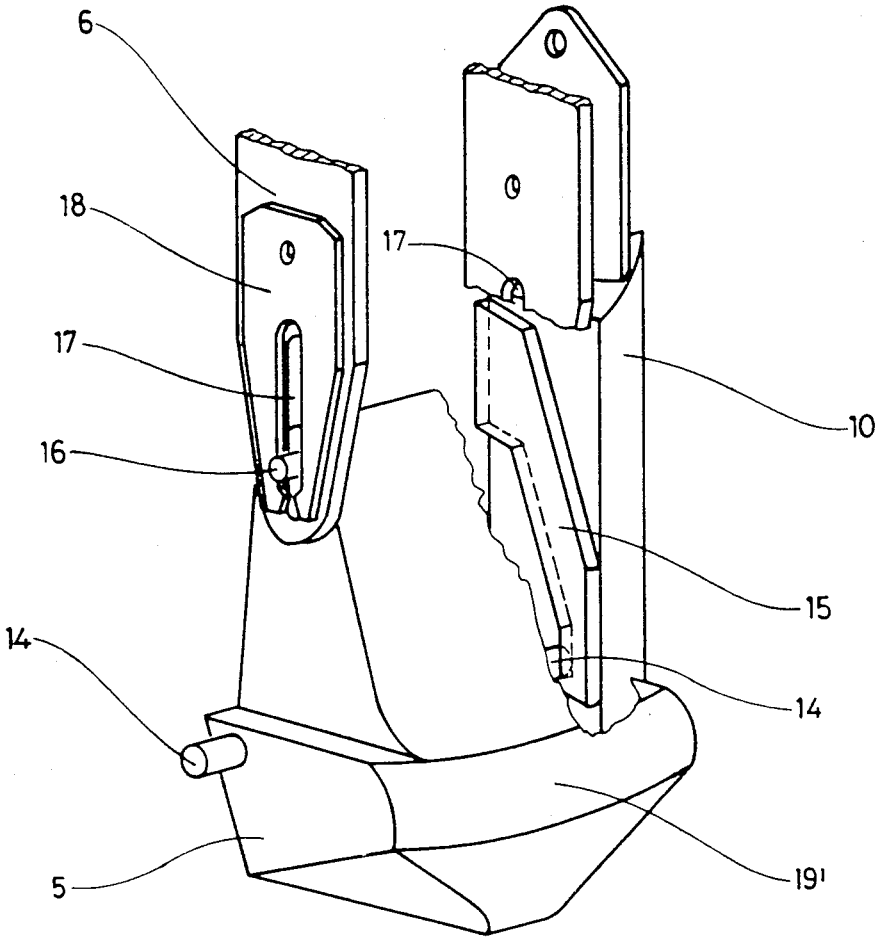
FIG. 6 is a partial perspective view to an enlarged scale showing a detail of the coupling according to the invention.

From the clamping levers 5 there laterally project (see specifically FIG. 6) two pegs 14 which slide along the guides 15 of the protection casings 10 to keep the clamping levers always adhering to the inclined surfaces of the coupling widened portion 4.

Specifically, the pegs 14 and guides 15 cause the clamping levers 5 to rotate inwards when these latter are raised, i.e. when the cylinders 9 are extended.

The connection between the clamping levers 5 and the arms 6 rigid with the wedges 3 (see specifically FIG. 6) is made by the pivots 16 of the clamping levers 5 passing through the slots 17 provided in the arms 6 rigid with the wedges 3. On the outer side of the arms 6, in correspondence with the slots 17, there are mounted springs of tuning-fork shape 18 having a mouth with its transverse dimension less than the diameter of the clamping lever pivot 16 so that said pivot 16 is retained at the lower end of said slots by the restriction represented by said mouth. In other words, when the pivots are at the lower end of the slots and thus in proximity with the mouth of the tuning-fork springs 18, the vertical movement of the pivots 16 within the slots 17 is opposed by the action of the mouth restriction of the springs themselves. Said movement can occur only if a force acts on the pivots 16 sufficient to widen the mouth of the tuning-fork springs 18 by the effect of their elastic deformation, this occurring when the wedges are moved by the hydraulic cylinders into their operating position after the clamping levers are already in theirs.

The engagement between the clamping lever pivots 16 and the slots 17 takes place under a slight constructional clearance so that when the coupling is clamped in its seat, movements of the clamping levers 5 caused by the forces which stress them do not give rise to any excessive stressing of the pivots 16.

The contact surfaces 19' and 19 between the clamping levers and the seat are of spherical or conical shape to allow the coupling to settle in its seat on effecting the relative clamping, and to distribute the contact pressure more uniformly.

The inclination of the wedges 3 and relative guides 2 is less than the minimum friction angle, to prevent them becoming slack during operation even if pressure is absent in the hydraulic cylinders 9. Lifting lugs 21 are fixed to the guide sleeve 8 for use if the emergency release procedure has to be carried out.

The hydraulic circuit for operating the wedges 3 and clamping levers 5 is located inside the coupling body, possibly in an oil bath at the pressure of the surrounding environment.

The coupling seat 22, fixed to the platform foundation structure 23, is of essentially cylindrical shape and comprises the ring 22' for supporting the wedges 3, and the ring 19 the spherical or conical inner surface of which forms the bearing surface for the surface 19' of the clamping levers 5.

The coupling is clamped to the seat in the following manner. The coupling with its hydraulic cylinders 9 extended as shown in FIG. 1 is inserted into its seat. The centering cone 20 fixed to the seat mouth facilitates this operation.

During this stage the clearance between the coupling and seat allows insertion even under conditions of eccentricity and misalignment., When the coupling is inserted into the seat as shown in FIG. 1 the retraction of the hydraulic cylinders 9 is commenced by feeding fluid into the platform circuit. The retraction of the cylinders 9 pulls the sleeve 8 downwards, so that this latter by means of the connecting links 7 urges the wedges 3 which then thrust the clamping levers 5 by virtue of the restriction to passage created by the narrow mouth of the tuning-fork springs 18 which act on the pivots 16. The clamping levers 5 descend to extend outwards, and when they have extended to their maximum degree and surmounted the widened portion 4 they are retained in that position by the pegs 14 engaged in the guides 15, this occurring before the wedges 3 have completed their movement. At this point the coupling is pulled upwards until the clamping levers 5 are brought into contact with the seat wall 19. As the retraction of the hydraulic cylinders 9 continues, the pivots 16 elastically expand the narrow mouth of the tuning-fork springs 18 and are able to continue to slide within the vertical slots 17, to enable the wedges 3 to descend into their operating position. This is attained by virtue of the fact that the wedges 3 are able to continue their downward travel until they rest against the wall 22' of the seat 22 after taking up the entire radial clearance. On termination of this operation the coupling is precisely aligned within the seat and is clamped therein.

The coupling is released from its seat by reversing the procedure described for its clamping.

Should a malfunction of the hydraulic circuit not allow the coupling to be clamped by the normal procedure, the emergency release procedure is carried out as follows.

Using auxiliary equipment (such as ropes extending from the platform or a jacking system installed on the foundation base 23) connected to the lifting lugs 21, the sleeve 8 is raised to drag with it the wedges 3 and release them from contact with the seat surface 22', this being possible in that the slots 17 allow relative movement between the clamping levers, which remain fixed in position, and the pivots 16 and consequently the wedges 3. The gap which thus forms between the wedges 3 and upper wall 22' of the seat 22 allows the coupling to descend and eliminate the mechanical interference between the clamping levers 5 and the spherical part 19 of the seat 22. On again raising the sleeve 8 the clamping levers 5 will also be raised, so that they simultaneously retract until the hooks 12 engage the respective connectors 13 fixed on the tubular body 1, so supporting the entire system comprising clamping levers 5, wedges 3 and sleeve 8. At this point the coupling can be extracted from its seat.

We claim:

1. A reversible mechanical coupling to be clamped within a suitable seat provided in particular in a foundation base for anchoring to said base one of the tensioned tubular anchorages of a tension leg marine platform, said coupling consisting substantially of a tubular body provided upperly with vertical guides for a series of wedges pivoted to a guide sleeve slidably driven along said body by hydraulic cylinders hinged between said body and said sleeve, and provided lowerly with a terminal widened portion arranged to cause radial expansion of an analogous series of clamping levers kept in contact with said body by mechanical means, characterised in that said clamping levers are pivoted respectively to arms rigid with said wedges, each by two lateral pivots which are inserted through corresponding vertical slots in said arms to slide therein and are retained at the lower end of said slots by the narrow but forcible mouth of two springs of tuning-fork shape mounted in correspondence with said slots, said mechanical means for maintaining contact between the clamping levers and said tubular body consisting of two pegs projecting laterally from each clamping lever and compelled to slide along guides of suitable shape provided in protection casings interposed between said clamping levers and fixed to the tubular body.

2. A reversible mechanical coupling as claimed in claim 1, characterised in that the engagement between said lateral pivots of the clamping levers and the corresponding slots is made with a slight constructional clearance.

3. A reversible mechanical coupling as claimed in claim 1, characterised in that the inclination of said wedges and relative vertical guides is less than the minimum friction angle.

4. A reversible mechanical coupling as claimed in claim 1, characterised in that said series of clamping levers and wedges comprises respectively corresponding three clamping levers and three wedges disposed mutually superposed at 120° apart.

* * * * *